US005355204A

United States Patent [19]

Aoki

[11] Patent Number: 5,355,204

[45] Date of Patent: Oct. 11, 1994

[54] IMAGE FIXING APPARATUS WITHOUT CREASE OF FIXING FILM

[75] Inventor: Kazuaki Aoki, Tokyo, Japan

[73] Assignee: Canon Kabushiki Kaisha, Tokyo, Japan

[21] Appl. No.: 59,728

[22] Filed: May 11, 1993

Related U.S. Application Data

[63] Continuation of Ser. No. 651,015, Feb. 4, 1991, abandoned.

[30] Foreign Application Priority Data

Feb. 9, 1990 [JP] Japan ..... 2-30650

[51] Int. Cl.[5] ..... G03G 15/20

[52] U.S. Cl. ..... 355/285; 219/216; 355/289

[58] Field of Search ..... 355/285, 289, 290, 282, 355/284; 219/216, 469, 470

[56] References Cited

U.S. PATENT DOCUMENTS

| | | | |
|---|---|---|---|
| 3,591,276 | 11/1967 | Byrne | 355/285 X |
| 3,884,623 | 5/1975 | Slack | 29/122 X |
| 4,059,394 | 11/1977 | Ariyama et al. | 432/59 |
| 4,768,434 | 9/1988 | Beery | 355/289 X |
| 4,937,631 | 6/1990 | Kim et al. | 355/290 |
| 4,954,845 | 9/1990 | Yano et al. | 355/290 |
| 4,955,221 | 9/1990 | Feldman et al. | 29/122 X |
| 4,998,121 | 5/1991 | Koh et al. | 346/160 |
| 5,026,276 | 6/1991 | Hirabayashi et al. | 432/59 |
| 5,027,160 | 6/1991 | Okada et al. | 355/282 |
| 5,043,763 | 8/1991 | Koh et al. | 355/206 |
| 5,084,738 | 1/1992 | Ishikawa | 355/285 |

FOREIGN PATENT DOCUMENTS

| | | | |
|---|---|---|---|
| 0295901 | 12/1988 | European Pat. Off. | 355/285 |
| 0095571 | 5/1987 | Japan | 355/285 |
| 63-76592 | 4/1988 | Japan . | |
| 63-82626 | 4/1988 | Japan . | |
| 63-91271 | 4/1988 | Japan . | |
| 0101850 | 5/1988 | Japan . | |
| 0185579 | 7/1989 | Japan | 355/285 |
| 1128357 | 9/1989 | Japan . | |

*Primary Examiner*—A. T. Grimley
*Assistant Examiner*—Thu Dang
*Attorney, Agent, or Firm*—Fitzpatrick, Cella, Harper & Scinto

[57] ABSTRACT

An image fixing apparatus includes a heater; a movable film in contact with the heater and movable together with a recording material carrying an image to be fixed; a pressing rotatable member for urging the recording material and the film to the heater; and wherein the heater is substantially crowned in a direction perpendicular to a movement direction of the film, and the pressing rotatable member is substantially reversely crowned in the same direction.

24 Claims, 5 Drawing Sheets

IMAGE FIXING APPARATUS WITHOUT CREASE OF FIXING FILM

This application is a continuation of application Ser. No. 07/651,015 filed Feb. 4, 1991, now abandoned.

FIELD OF THE INVENTION AND RELATED ART

The present invention relates to an image fixing apparatus usable with an image forming apparatus such as a copying machine or a printer, more particularly to a heat-fixing image fixing apparatus wherein an image is fixed by heat from a heater through a film.

In a widely used conventional image fixing apparatus wherein the toner image is fixed on the recording medium supporting an unfixed toner image, the recording medium is passed through a nip formed between a heating roller maintained at a predetermined temperature and a pressing or back-up roller having an elastic layer and press-contacted to the heating roller. This system however involves the problem that the warming-up period is relatively long until the temperature of the heating roller reaches a predetermined level, In order to solve the problem, U.S. Ser. No. 206,767, now abandoned in favor of U.S. Ser. No. 668,333, U.S. Pat. No. 4,954,845, U.S. Ser. No. 409,341, now U.S. Pat. No. 5,043,763, 416,539, now U.S. Pat. No. 4,998,121, 426,082, now U.S. Pat. No. 5,026,276, 435,247, now abandoned in favor of U.S. Ser. Nos. 735,709, 430,437, 440,380, now abandoned in favor of U.S. Ser. Nos. 751,571, 440,678, 444,802 and 446,449, now U.S. Pat. No. 5,027,160 which have been assigned to the assignee of this application, have proposed a novel fixing apparatus using an instantaneously heatable thermal head and a thin film.

In such a novel fixing apparatus, the use is made with a thin film and a driving roller for driving the film under tension.

In order to maintain uniform tension over the width of the film, the members applying the tension to the film is required to be very accurate. If it or they involve variation, the film slacks in the middle of the width with the result of crease of the film.

The pressing roller presses the film to the heater to form a nip between the film and the pressing roller. When the recording material is in the nip, the recording material is creased, or the trailing edge of the recording material is unintentionally raised.

SUMMARY OF THE INVENTION

Accordingly, it is a principal object of the present invention to provide an image fixing apparatus wherein the production of the crease of the film moving together with the recording material in contact with the heater, is effectively prevented.

It is another object of the present invention to provide an image fixing apparatus wherein the production of the crease of the recording material passing through the nip formed between the film and the pressing member, is effectively prevented.

It is a further object of the present invention to provide an image fixing apparatus wherein the production of the crease in the recording material is prevented by which the trailing edge of the recording material is prevented from rising when the recording material is in the nip between the film and the pressing member.

It is a yet further object of the present invention to provide an image fixing apparatus wherein the heater is crowned in a direction substantially perpendicular to the movement direction of the film.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
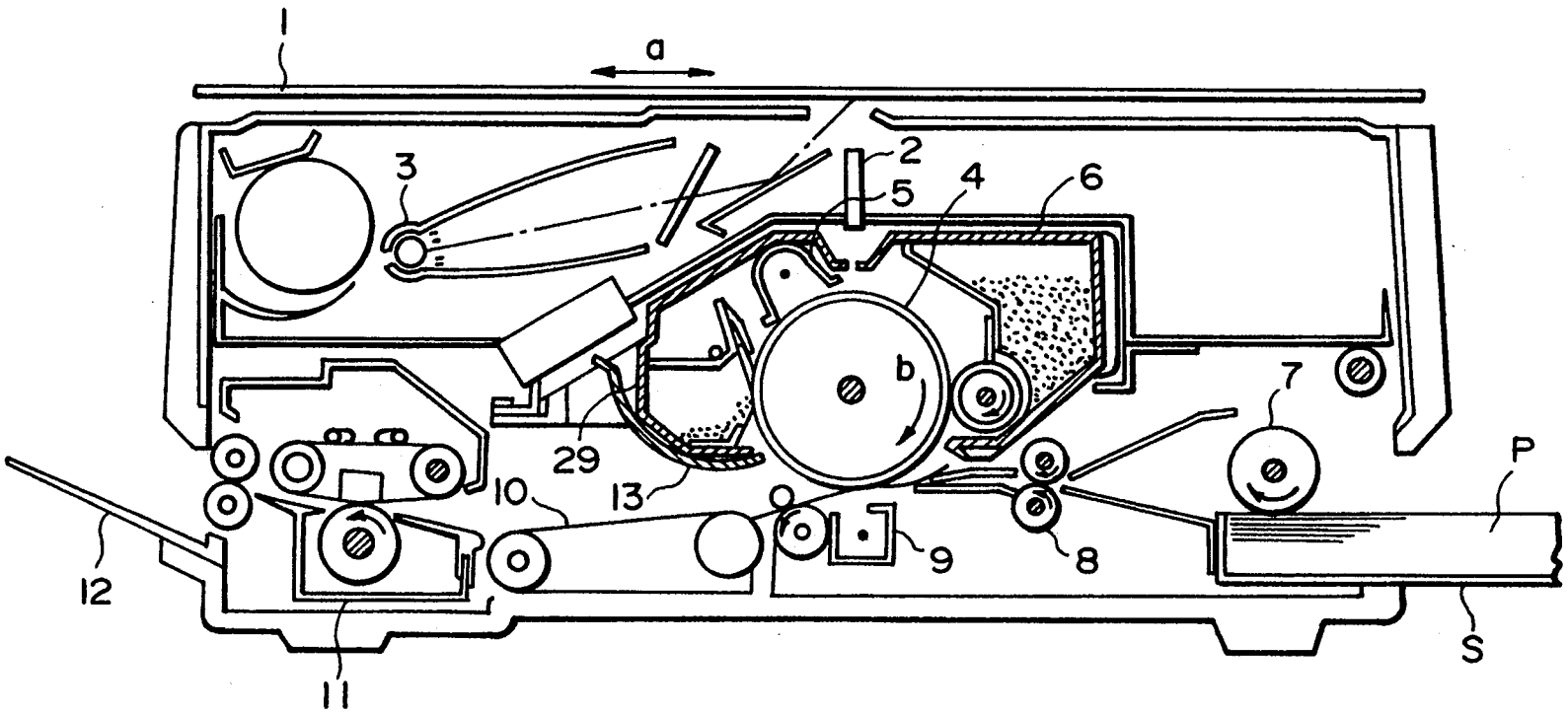
FIG. 2 is a sectional view of an image forming apparatus using the image fixing apparatus of FIG. 1.

Referring first to FIG. 2, there is shown an image fixing apparatus according to an embodiment of the present invention. The image forming apparatus comprises an original supporting platen 1 made of transparent material such as glass and reciprocable in the direction a to scan an original. Right below the original carriage, an array of short focus imaging elements is disposed. An original placed on the original carriage is illuminated by an illumination lamp 3, and the reflected light image is projected through a slit and through said array onto a photosensitive drum 4.

The photosensitive drum rotates in the direction b. The photosensitive drum 4 has a zinc oxide photosensitive layer or an organic photoconductor photosensitive layer or the like. A charger 5 uniformly charges the surface of the photosensitive drum. The drum 4 thus uniformly charged by the charger is exposed to the image light through the array 2, so that an electrostatic latent image is formed. The latent image is visualized with a toner made of heat-softening or heat-fusible resin by a developing device. On the other hand, a sheet P (recording material) accommodated in a cassette S is fed to the drum 4 by a pick-up roller 7 and registration rollers 8 rotates in synchronism with the image on the photosensitive drum 4. The toner image formed on the photosensitive drum 4 is transferred onto the sheet P by a transfer discharger 9. Thereafter, the sheet P is separated from the drum 4 by a known separating means, and is introduced along the conveying guide 10 into an image fixing apparatus 11 where it is subjected to the heat-fixing operation. Then, the sheet is discharged onto the tray 12. After the toner image has been transferred, the residual toner remaining on the photosensitive drum 4 is removed by a cleaner 20.

Figure 1:
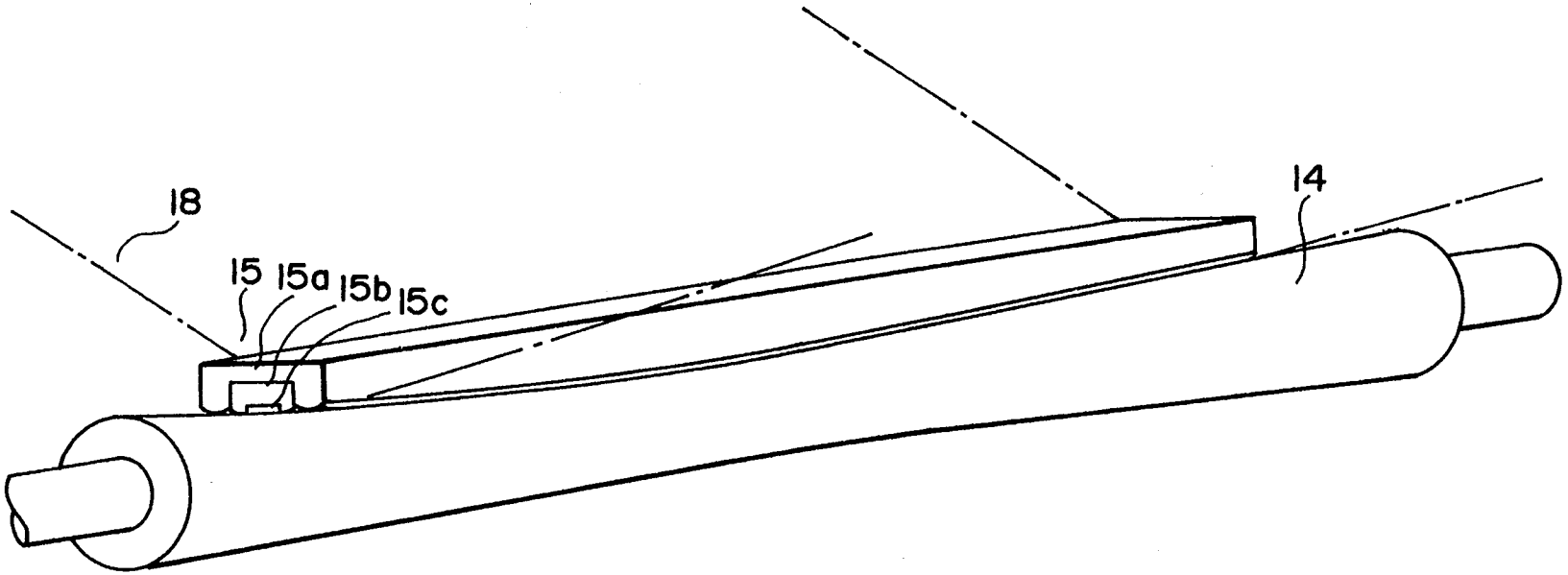
FIG. 1 is a perspective view of an image fixing apparatus according to an embodiment of the present invention.

Referring now to FIG. 1, there is shown an image fixing apparatus 11 comprising a low thermal capacity linear heat-generating element (heater) 15, a film 18 in contact with the heater 15, a pressing or back-up roller 14 for urging the film 18 to the heater 15. The pressing roller rotates following the film which is driven.

Figure 3:
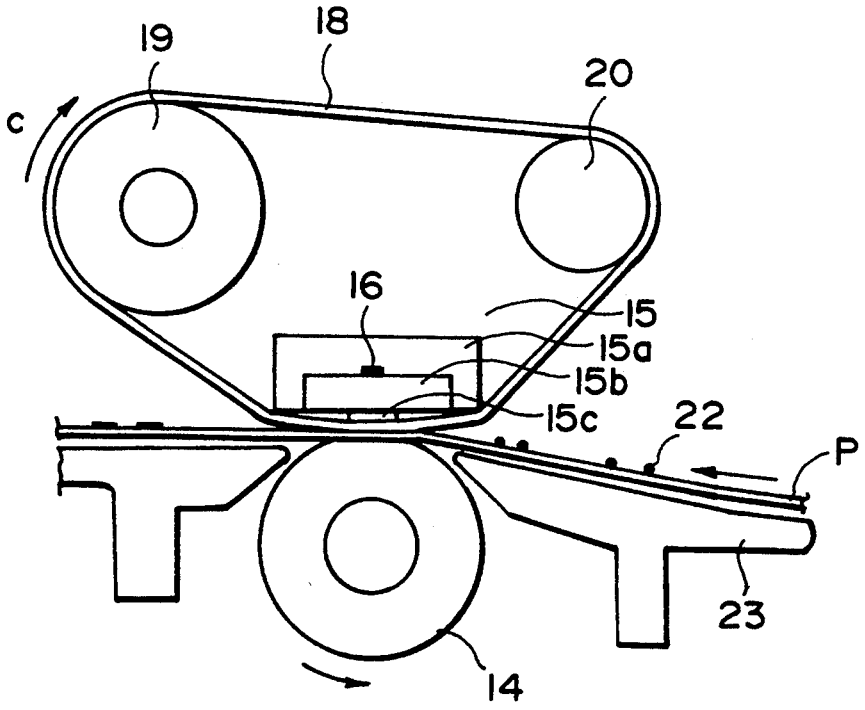
FIG. 3 is a sectional view of an image fixing apparatus according to another embodiment of the present invention.

FIG. 3 is an enlarged sectional view of the image fixing apparatus 11 shown in FIG. 2.

The heater 15 is fixed at least during the fixing operation and comprises an alumina base plate 15b having a thickness of 1.0 mm, a width of 10 mm and a length of 240 mm, for example and made of good thermally conductive material, a holder 15*a* made of heat insulative material for supporting the alumina base plate 15*b*, and a heat generating resistor 15*c* applied on the alumina base plate 15*b* in a width of 1.0 mm. The longitudinal ends of the heater 15 are connected with a power source supplying 100 Vdc pulses at the frequency of 20 msec.

A temperature sensor 16 is in the form of a thermister for detecting a temperature of the alumina base plate 15*b*, and the width of the pulse applied to the heat generating resistor is controlled generally within the range of 0.5–5 msec so as to the temperature detected by the temperature sensor 16 is constant. The temperature of the toner at the point where the film 18 is separated from the recording material 21 is selected to be higher than the glass transition point of the toner, preferably higher than a softening temperature of the toner (ball and ring method).

The fixing film 18 slides on the heater 15 in the direction indicated by an arrow c, the heater 15 being maintained at a predetermined temperature. The fixing film 18, for example, comprises a heat resistive film of polyimide (PI), polyether imide (PEI), polyether sulfone (PES) or perfluoroalkoxy (PFA), having a thickness of 20 microns, and a parting layer made of polytetrafluoroethylene (PTFE) or another fluorinated resin, having a thickness of 10 microns, at least at an image contactable side. It is in the form of an endless belt, for example. Generally, the total thickness of the film is less than 100 microns, preferably not more than 40 microns. The fixing film 18 is stretched around a driving roller 19 for driving the film 18 and a follower roller 20 driven by the film 18, and by the driving force and the tension thereby, it is moved without crease in the direction c.

The pressing roller 19 has a rubber elastic layer made of silicone rubber or the like having a good parting property. It applies pressure to the low thermal capacity linear heater 15 through the fixing film with the total pressure of 4–7 kg.

The unfixed toner image 22 on the recording material P is introduced along an inlet guide 23 into a nip (contact area) between the film 18 and the pressing roller 14. The recording material 21 is pressed to the heater 15 through the film by the pressing roller 14 in the nip. The side of the recording material 21 that bears the toner image 22 is contacted to the film 18, and the fixed image is provided by the heating.

In this embodiment, the crease of the film is not produced even if there is a slight variation in the parallelism among the driving roller 19, the follower roller 20 and the heater 15.

The reason for this will be described in detail.

Referring to FIG. 3, the fixing film 18 is tensioned around the driving roller 19, the follower roller 20 and the low thermal capacity linear heater 15. If the longitudinal surface of the heater 15 which is contactable to the film 18 is straight, the tension of the film 18 in the middle part of the length of the heater becomes smaller than the tensions at the opposite ends, due to the variation of the roller or rollers in the cylindricity and straightness and/or due to the central deformation of the roller or rollers when the tension is applied. This results in the tendency of the lateral ends of the film moving toward the longitudinal centers of the heater. Since the film is thin, creases are produced adjacent the lateral center of the film.

As shown in FIG. 1, the bottom surface (near the recording material) of the low thermal capacity linear heater 15 is concaved down or crowned in the longitudinal direction. By doing so, the weakening of the tension at the middle of the film is prevented. The longitudinal crowning of the heater 15 is such that the holder 15*a*, the alumina substrate 15*b* and the heat generating resistor material 15*c* are all crowned toward the recording material so that the longitudinal crowned portion of the heater 15 is contacted to the film 18.

By increasing the tension in the middle of the width of the film by the crowning configuration of the heater 15, the film is prevented from creasing.

However, when the heater 15 is crowned, the pressure in the middle portion becomes larger than the marginal portions.

The conveying force applied to the recording material is larger at the portion where the nip pressure is large than at the portion position where it is small. Therefore, when the thickness of the recording material is small, the crease may be produced by the force toward the inside in the direction of the width of the film, to the recording material P.

In consideration of this, in addition to the longitudinal crowning of the low thermal capacity linear heater 15, the pressing roller 14 is reversely crowned in the longitudinal direction to match with the crowning of the heater. By the reverse-crowning, the recording material can receive the outward forces in the direction of the width of the film, so that the recording material is prevented from creasing.

If the laterally outside conveying force of the recording material is too high as compared with that in the middle, the end portions of the recording material P are pulled, so that the trailing edge portion of the recording material P is raised upwardly, that is, toward the position where the film 18 exist beyond a nip line between the film 18 and the pressing roller 14.

If the trailing edge rise of the recording material P is too large, the following problem is possible. When a process cartridge including the photosensitive drum 4 shown in FIG. 2, for example, is taken out of the image forming apparatus, the trailing edge portion of the recording material P is rubbed with a member such as a drum shutter 13 for covering the photosensitive drum 4 which is disposed between the photosensitive drum 4 and the fixing device 11 and which is disposed adjacent the recording material passage at the film 18 side beyond the nip line between the film 18 and the pressing roller 14. If this occurs, the unfixed toner image 22 on the recording material P will be disturbed.

The rising of the recording material trailing edge is concerned with the crowning of the low thermal capacity linear heater and the reverse-crowning of the pressing roller, more particularly, the configuration and the degree (amount) thereof.

Figure 4:
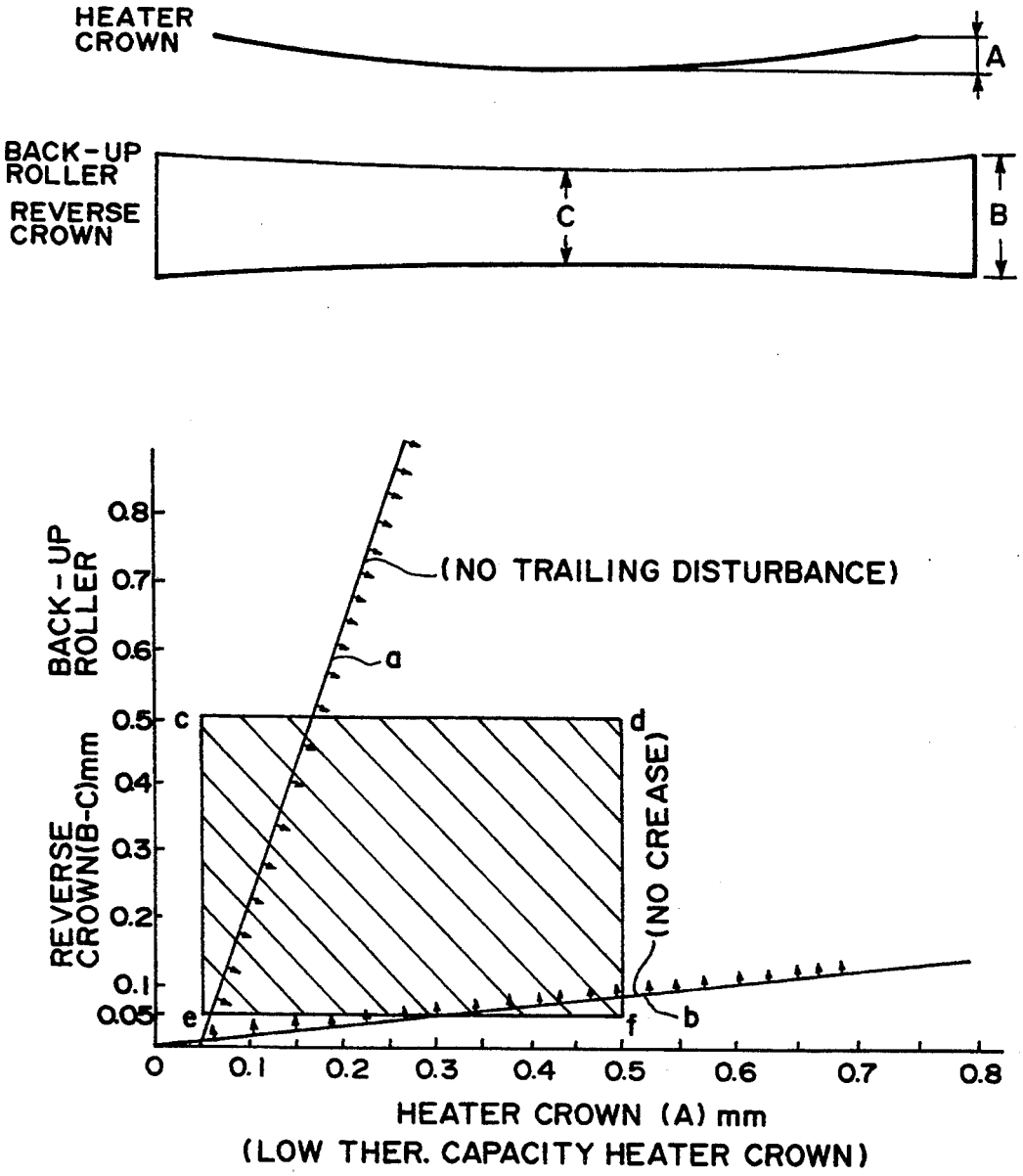
FIG. 4 is a graph showing a relation between an amount of a heater crowning and an amount of reverse-crowning of a pressing roller.

FIG. 4 is a graph showing the production of the crease of the recording material 21 and the disturbance to the image by the trailing edge rising in connection with a combination of the crowning of the low thermal capacity linear heater 15 and the reverse-crowning of the pressing roller 14 when the total pressure by the pressing roller 14 is 6 kg, and the conveying speed of the recording material is 50 mm/sec, in the experiments carried out by the inventor. In FIG. 4, A represents the amount of the crowning of the heater, and B-C represent the amount of the reverse-crowning of the pressing roller. FIG. 4 shows the case in which a thin water-absorbed sheet which is most easily creased and with which the trailing edge image disturbance is most easily produced. The region a designates by the arrows is the region in which the trailing edge image disturbance is not produced, and a region b designates by arrows is the region in which the crease is not produced.

If the amount of the crowning of the heater is too large, the film is largely slacked at the ends thereof, and therefore it is preferably not more than 0.5 mm.

If the amount of the reverse-crowning of the pressing roller is too large, the pressure at the central portion decreases with the possible result of offset, and therefore it is preferably not more than 0.5 mm.

In view of the results shown in FIG. 4, the amount of the reverse-crowning of the pressing roller is selected to be 0.05–0.5 mm from the standpoint of preventing the crease of the recording material.

In this case, in order to prevent the image disturbance at the trailing edge of the recording material, the amount of the crowning of the heater is set to be 0.2–0.5 mm.

However, since the heater is fixed by the holder and other metal plates, the positioning of the heater is difficult because of the integration of the tolerances for the respective elements. Therefore, the tolerable range for the amount of the heater crowning is preferably large.

Figure 5:
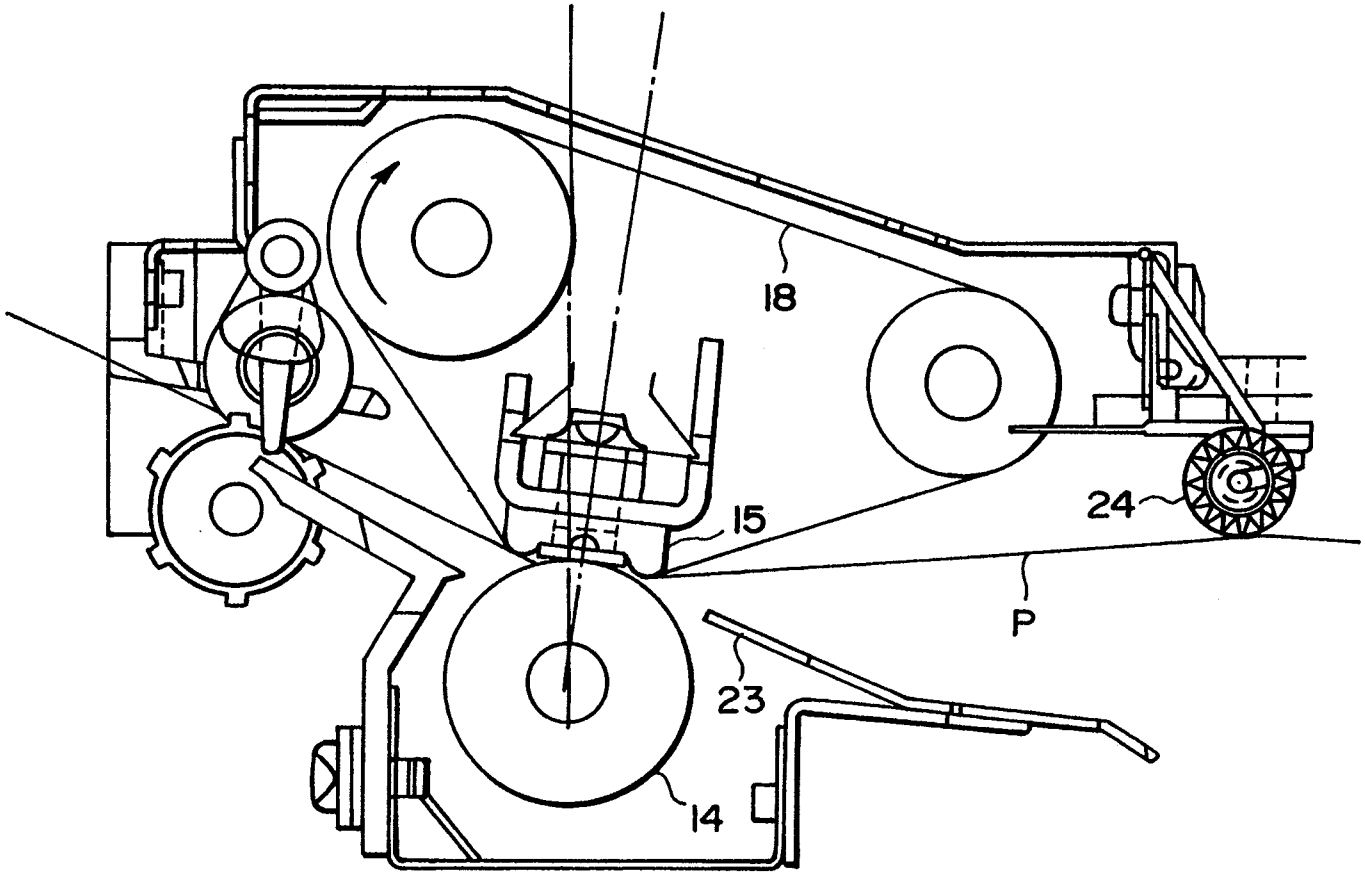
FIG. 5 is a sectional view of an image fixing apparatus according to a further embodiment of the present invention.

FIG. 5 shows another embodiment of the present invention, wherein the tolerable range is expanded. Spurs 24 are provided in this embodiment at an upstream side of the nip between the film 18 and the pressing roller 14 with respect to the movement direction of the recording material. The spurs 24 are disposed near such a side of the recording material P as is contactable to the film 18 and away from the passage for the recording material P. Therefore, only when the trailing edge portion of the recording material P is raised, and therefore, travels upwardly and away from the normal conveying passage, does the spur or spurs 24 contact the recording material P to suppress the trailing edge rising, thus preventing the disturbance of the image adjacent the trailing edge of the recording material P. It is preferable that the spur has teeth each of which is sharp so that the toner image is not disturbed when they are contacted to the toner image.

By the provision of the rotatable member effective to suppress the rising of the trailing edge portions of the recording material, the tolerable range for the amount of the heater crowning can be expanded. In this embodiment, it is 0.05–0.5 mm.

It has been confirmed in experiments that when the amount (degree) of the heater crowning and the amount (degree) of the reverse-crowning of the pressing roller are substantially the same, the crease production of the film and the trailing edge disturbance of the recording material are most effectively prevented.

The image forming apparatus to which the image fixing apparatus according to the present invention is applicable is not limited to the copying machine as shown in FIG. 2, but the present invention is also applicable to an electrophotographic printer, electrostatic recording apparatus or the like.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a stationary heater;

an endless film extending around said heater; and a backup rotatable member for forming a nip with said heater with said film therebetween, wherein a recording material carrying an image is passed through a nip between said film and said backup rotatable member by which the image is fixed; and wherein said heater is substantially crowned in a direction perpendicular to a movement direction of said film, and said backup rotatable member is substantially reversely crowned in a direction perpendicular to a movement direction of said film.

2. An apparatus according to claim 1, wherein said film slides on said heater.

3. An apparatus according to claim 1, wherein said backup rotatable member has a rubber layer.

4. An apparatus according to claim 1, wherein an amount of crowning of said heater is substantially equal to an amount of reverse-crowning of said backup rotatable member.

5. An apparatus according to claim 1, wherein, the heater is crowned 0.05–0.5 mm.

6. An apparatus according to claim 1, wherein the backup rotatable member is reversely crowned 0.05–0.5 mm.

7. An apparatus according to claim 1, wherein the image to be fixed is made of toner, and wherein a temperature of the toner at a point where the recording material is separated from said film is higher than a glass transition point of the toner.

8. An apparatus according to claim 1, wherein said film has a thickness less than 100 microns.

9. An apparatus according to claim 8, wherein said film has a thickness less than 40 microns.

10. An image fixing apparatus, comprising:

a stationary heater; and an endless film extending around said heater, said film being in press contact with said heater and movable together with a recording material carrying an image to be fixed, wherein the image is heated and fixed by heat from said heater through said film, wherein a surface of said heater contactable to said film is substantially crowned in a direction perpendicular to a movement direction of said film, and the heater is crowned 0.05–0.5 mm.

11. An apparatus according to claim 10, further comprising a pressing member for pressing the recording material and said film to said heater.

12. An apparatus according to claim 10, wherein the image to be fixed is made of toner, and wherein a temperature of the toner at a point where the recording material is separated from said film is higher than a glass transition point of the toner.

13. An apparatus according to claim 10, wherein said film has a thickness less than 100 microns.

14. An apparatus according to claim 13, wherein said film has a thickness less than 40 microns.

15. An image fixing apparatus, comprising:

a stationary heater;

an endless film extending around said heater;

a backup member forming a nip with said film therebetween, wherein a recording material carrying an image to be fixed is passed through the nip between said film and said backup member, by which the image is fixed, wherein a surface of said heater contactable to said film is substantially crowned in a direction perpendicular to a movement direction of said film; and a rotatable member, disposed upstream of the nip with respect to a movement direction of the recording material toward said film, for preventing departure of a trailing edge portion of the recording material from the passage.

16. An apparatus according to claim 15, wherein the recording material is contactable to said film at its image carrying side.

17. An apparatus according to claim 16, wherein said rotatable member includes a spur.

18. An apparatus according to claim 15, wherein said pressing member is a rotatable member having a rubber layer.

19. An apparatus according to claims 18, wherein a diameter of said rotatable member increases toward longitudinal outsides thereof from its longitudinal central portion.

20. An apparatus according to claim 15, wherein said film slides on said heater.

21. An apparatus according to claim 15, wherein the heater is crowned 0.05–0.5 mm.

22. An apparatus according to claim 15, wherein the image to be fixed is made of toner, and wherein a temperature of the toner at a point where the recording material is separated from said film is higher than a glass transition point of the toner.

23. An apparatus according to claim 16, wherein said film has a thickness less than 100 microns.

24. An apparatus according to claim 23, wherein said film has a thickness less than 40 microns.

* * * * *

UNITED STATES PATENT AND TRADEMARK OFFICE

CERTIFICATE OF CORRECTION

PATENT NO. : 5,355,204
DATED : October 11, 1994
INVENTOR(S) : KAZUAKI AOKI

It is certified that error appears in the above-indentified patent and that said Letters Patent is hereby corrected as shown below:

On title page, item [56], "Reference Cited",
'3,591,276 11/1967 Byrne" should read
--3,591,276 7/1971 Byrne--;
"Feldmen et al." should read —Feldmann et al— and "1128357 9/1989 Japan" should read
--1-128357 9/1989 Japan--.

Column 1,
line 24, "level," should read --level.--.

Column 4,
line 22, "large" should read --larger--; and
line 40, "exist" should read --exists--.

Column 5,
line 6, "designates" should read --designated--.

Signed and Sealed this
Sixth Day of June, 1995

Bruce Lehman

*Attest:*

BRUCE LEHMAN

*Attesting Officer*

*Commissioner of Patents and Trademarks*